US005649690A

United States Patent [19]

Kilmer

[11] Patent Number: 5,649,690

[45] Date of Patent: Jul. 22, 1997

[54] MOVABLE FENCE POST SYSTEM

[76] Inventor: Willis G. Kilmer, 4730 Antioch Rd., Merriam, Kans. 66203

[21] Appl. No.: 587,211

[22] Filed: Jan. 16, 1996

[51] Int. Cl.[6] ..... E04H 17/08

[52] U.S. Cl. ..... 256/35; 256/40; 248/156; 52/155

[58] Field of Search ..... 256/35–37, 40, 256/64, 63, 30, 31, 32, 1, DIG. 5; 52/146, 152, 293.3, 293.1, 155, 165, 153, 169.9; 248/530, 156, 523

[56] References Cited

U.S. PATENT DOCUMENTS

| | | | |
|---|---|---|---|
| 308,024 | 11/1884 | West . | |
| 343,171 | 6/1886 | Hanna | 52/146 |
| 580,311 | 4/1897 | Hammett | 256/64 |
| 732,974 | 7/1903 | Van Valkenburg . | |
| 1,030,411 | 6/1912 | Larsen | 256/32 |
| 1,764,207 | 6/1930 | Johnson . | |
| 2,264,493 | 12/1941 | Werning | 52/165 |
| 3,724,145 | 4/1973 | Daniel | 256/32 X |
| 3,823,832 | 7/1974 | Cobb | 248/156 X |
| 4,243,207 | 1/1981 | Heykants | 256/64 |
| 4,402,166 | 9/1983 | Wortham, Jr. | 52/155 |
| 4,429,849 | 2/1984 | Maier | 52/155 X |
| 4,593,872 | 6/1986 | Svensson | 248/156 |
| 4,803,812 | 2/1989 | Alexander, Sr. . | |
| 4,923,165 | 5/1990 | Cockman | 248/156 X |
| 5,139,235 | 8/1992 | Kilmer . | |

FOREIGN PATENT DOCUMENTS

| | | | |
|---|---|---|---|
| 189962 | 8/1986 | European Pat. Off. | 256/DIG. 5 |
| 362665 | 10/1922 | Germany | 52/155 |
| 3533282 | 4/1986 | Germany | 256/19 |
| 1048439 | 11/1966 | United Kingdom | 256/35 |

*Primary Examiner*—Harry C. Kim

*Attorney, Agent, or Firm*—Hovey, Williams, Timmons & Collins

[57] ABSTRACT

A highly portable fence post support system has a base member presenting a support face configured for engaging the surface of the ground for supporting the base member on the ground in a support position, and an anchoring device configured for insertion into the ground. The base member includes support structure for removably receiving a post and for supporting the post in an upright orientation when the base member is in the support position. The base member further includes coupling structure for coupling the base member with the anchoring device for preventing the support face from disengaging the surface of the ground when the device is inserted into the ground. The coupling structure is spaced from the support structure.

29 Claims, 2 Drawing Sheets

MOVABLE FENCE POST SYSTEM

BACKGROUND OF THE INVENTION

1. Field of the Invention

The present invention relates generally to fences and, more particularly, to a highly portable fence post system having a post for supporting a number of wires, a base member configured for placement on the ground for supporting the post, and an anchoring device for anchoring the base member to the ground when the device is inserted into the ground.

2. Discussion of Prior Art

Fences are often utilized to enclose large tracts of land, necessitating quick and simple, yet effective installation of the fence posts, anchoring structure for securing the posts to the ground in an upright orientation, and wire. The versatility of the fence components and installation thereof is highly critical since the fence may traverse both rocky and fine soils. Removal of the fence posts and anchoring structure also must be readily accomplished as such components deteriorate and require replacement. Moreover, many farmers practice rotational grazing, in which animals are alternated from field to field so that the pasture is not entirely consumed or destroyed by the animals. In some circumstances, farmers utilize temporary fences to rotate confinement of the animals between fields. Temporary fences may consist of permanently anchored posts, in which the farmer selectively installs wire to the permanent posts to close off portions of the land. Alternatively, posts may be removed from the ground and relocated, whereby the farmer has the ability to vary the size and shape of the field upon which the animals graze. With moveable fence post systems, the portability and ready removal and installation of the posts and anchoring structure are critical. Of course, other situations may arise where a fence owner is required to move the fence.

However, fence posts and anchoring structure have heretofore been difficult to install and impractical for relocation within the field. Traditional fence posts provide no intrinsic lateral support, yet must support wires that are significantly tensioned. Accordingly, either the post must be driven deeply into the ground or relatively deep holes for receiving the post therein must be dug, both of which are relatively laborious. Yet posts placed directly into the earth are difficult to remove. Consequently, fence post systems have been devised with posts that are not driven or placed into the ground, but supported above the surface of the ground by anchoring structure. Such a system commonly includes an anchoring device, such as an auger, having a coupling portion for supporting the post coaxially therewith. However, anchoring devices still often require the excavation of a hole for receiving the device. Additionally, the design of traditional fence post systems limit installation to either rocky or fine soils. Finally, in order to withstand the lateral forces attributable to the tension of the wires supported by the post, angled braces have been connected between the post and the ground. A separate anchoring device is often necessary for securing the brace to the ground, which of course further complicates installation and removal.

SUMMARY OF THE INVENTION

Responsive to these problems, I have devised a fence post support apparatus including a base member presenting a support face configured for engaging the surface of the ground for supporting the base member on the ground in a support position. The base member includes support structure for removably receiving a post and for supporting the post in an upright orientation when the base member is in the support position. The apparatus further includes an anchoring device configured for insertion into the ground. The base member also includes coupling structure for coupling with the anchoring device for preventing the support face from disengaging the surface of the ground when the device is inserted into the ground. The structure for coupling with the anchoring device is spaced from the structure for supporting the post.

Preferably, the support structure includes a post passageway configured for receiving a post and extending through the base member transverse to the support face. A post, along with structure for preventing removal of the post from the base member when the post is received therein, is also provided.

The anchoring device may be configured as a stake or an auger. With a stake, the coupling structure takes the form of a stake passageway extending through the base member at an acute angle relative to the support face and transverse to the long axis of the base member. Alternatively, when utilizing an auger, the coupling structure includes an auger passageway extending through the base member transverse to the support base.

The preferred apparatus also includes a brace connected between the post and the base member. The base member is provided with structure defining a brace passageway terminating at a bearing surface within the base member. The brace passageway is spaced from the post passageway and is configured for receiving the brace therein. Additionally, the brace passageway extends outwardly from the bearing surface toward the post at an acute angle relative to the support face.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
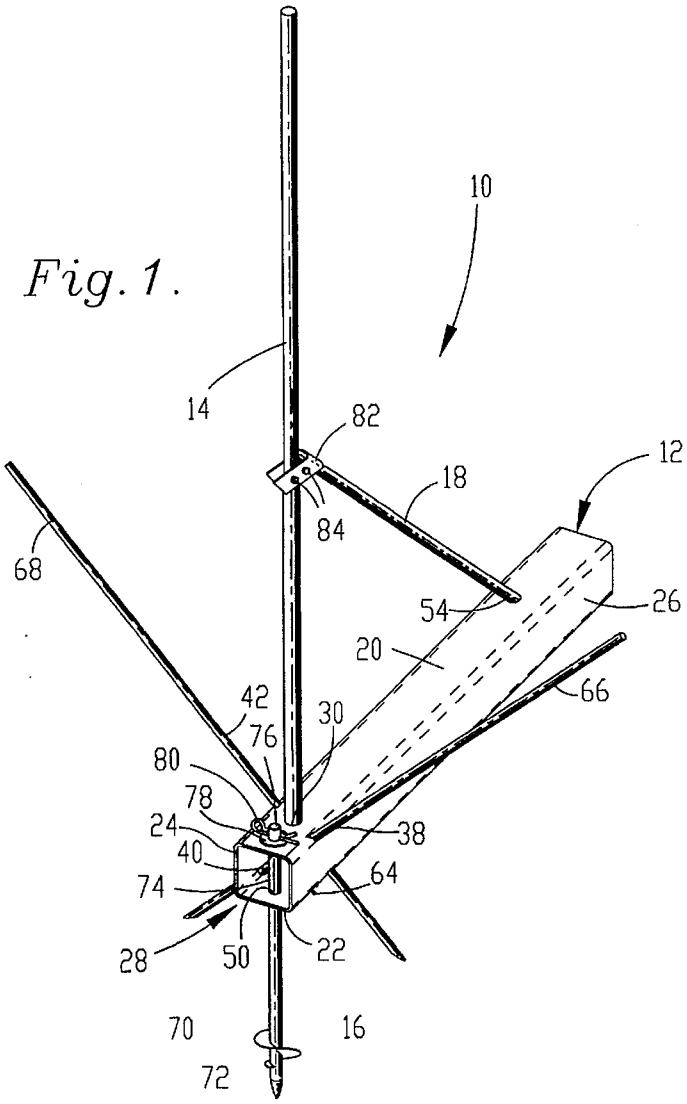
FIG. 1 is a perspective view of a fence post support apparatus constructed in accordance with the preferred embodiment of the invention.

Turning now to the drawings, and particularly FIG. 1, the preferred embodiment of the present invention contemplates a fence post support apparatus 10 generally including an elongated, tubular base member 12 for positioning on the ground in a support position, a post 14 removably received in base member 12 and supported thereby in an upright orientation, and various anchoring devices, generally denoted by the numeral 16, coupled with base member 12 and inserted into the ground for preventing base member 12 from lifting off the ground. Preferably, an angled brace 18 is connected between base member 12 and post 14.

Base member 12 defines a long axis 19 and preferably presents a square cross-section, top face 20, support face 22, parallel left and right faces, 24 and 26, and central opening 28; although the shape and size of base member 12 may be varied as desired. A pair of coaxial circular apertures 30 and 32 centrally located along the width of top face 20 and support face 22, respectively, cooperatively define a post passageway 34 configured for removably receiving post 14 and supporting the same in an upright orientation when base member 12 is in the support position.

Figure 2:
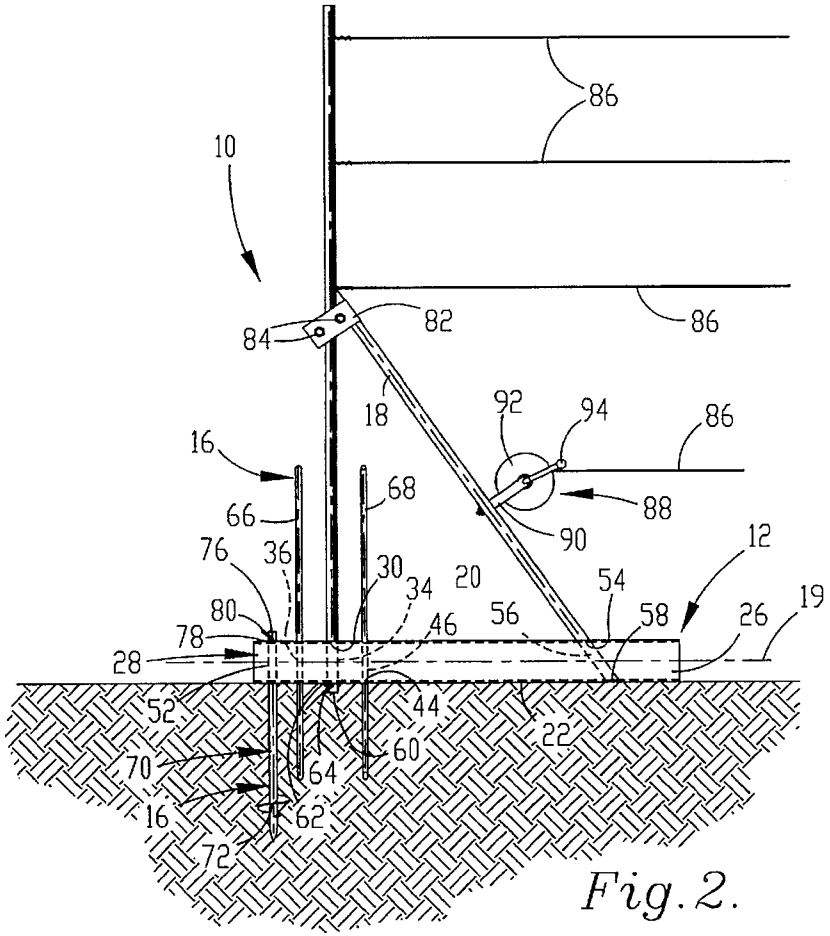
FIG. 2 is a side elevational view of the apparatus illustrated in FIG. 1, particularly illustrating the apparatus anchored to the ground and connected to a plurality of wires.
Figure 3:
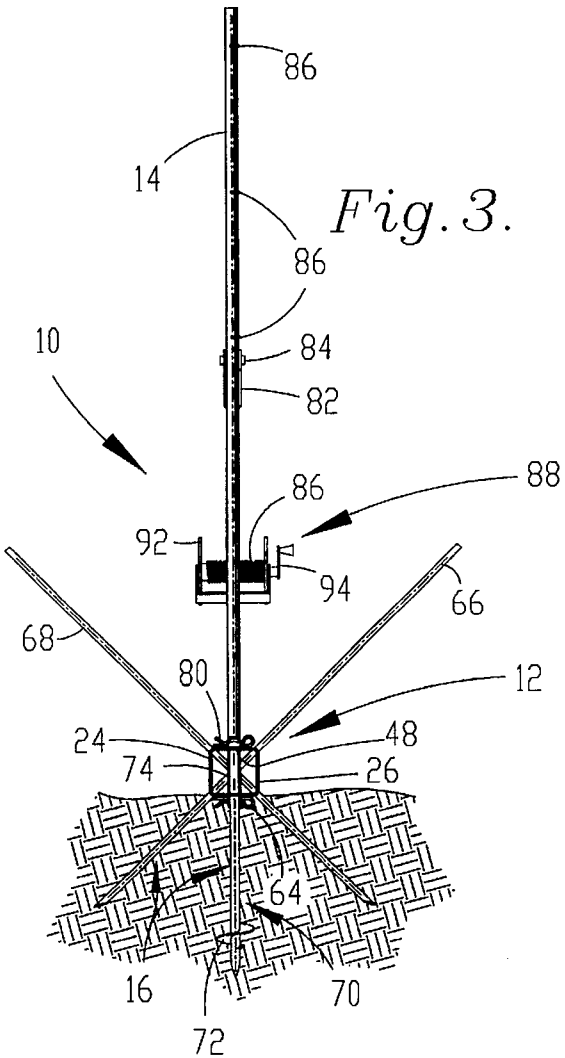
FIG. 3 is an end view of the apparatus illustrated in FIG. 2.

The preferred structure for coupling base member 12 with anchoring devices 16 includes an outboard stake passageway 36 defined by central opening 28, a circular aperture 38 in the upper right corner of base member 12 and a diagonally opposed, circular aperture 40 in the lower left corner (viewing FIGS. 1 and 3). Accordingly, outboard stake passageway 36 extends through the base member at a 45 degrees angle relative to support face 22 and transverse to long axis 19. A pair of diagonally opposed, circular apertures 42 and 44 and central opening 28 define a similar inboard stake passageway 46 spaced, along long axis 19, from outboard stake passageway 36 and transverse thereto. Preferably, post passageway 34 is positioned between outboard stake passageway 36 and inboard stake passageway 46. Finally, a circular aperture 48 centrally located along the width of top face 20, a coaxial circular aperture 50, and central opening 28 cooperatively define an auger passageway 52, which is positioned adjacent the outboard end of base member 12 (or left end viewing FIG. 2).

Base member 12 further includes an oblong aperture 54 defined centrally along the width of top face 20, wherein aperture 54 and central opening 28 cooperatively define a brace passageway 56 configured for receiving brace 18 at an acute angle relative to support face 22. Support face 22 does not include an aperture for receiving brace 18, but presents a solid beating surface 58 from which brace passageway 56 outwardly extends. While post passageway 34, stake passageways 36,46, and auger passageway 52 are positioned relatively close to one another, brace passageway 56 is remotely positioned adjacent the inboard end of base member 12 (or right end viewing FIG. 2).

Post 14 preferably has a cylindrical cross-section and is snugly received within post passageway 34, whereby post 14 is disposed in a generally vertical orientation when base member 12 is in its support position. The preferred apparatus 10 includes suitable means for preventing removal of post 14 from base member 12. If desired, post 14 has a portion 60 projecting slightly below support face 22 so that an oversized washer 62 and a cotter pin 64 may be coupled thereto for preventing removal of post 14 from base member 12 when base member 12 is in the support position. Specifically, cotter pin 64 is received in a diametrical opening (not shown) in portion 60, with washer 62 positioned on portion 60 between pin 64 and support face 22. Accordingly, when post 14 experiences upward forces, cotter pin 64 bears against washer 62, which in turn bears against support face 22, preventing removal of post 14. Anchoring devices 16 preferably include either a pair of elongated, rod-shaped outboard and inboard stakes, 66 and 68, or an elongated auger 70 having an auger flight 72 adjacent the lower end thereof and presenting a cylindrical upper section 74. Although apparatus 10 is illustrated as having both stakes 66,68 and auger 70, those skilled in the art will appreciate stakes 66,68 are more suitable for rocky soils, while auger 70 is typically provided when anchoring base member 12 to finer or sandier soils. In other words, apparatus 10 is usually provided with one or the other anchoring devices 16, depending upon the soil conditions. In circumstances involving stakes 66 and 68, each of stakes 66 and 68 are removably received in outboard and inboard stake passageways 36 and 46, respectively. On the other hand, auger passageway 52 is configured for receiving upper section 74. Similar to post 14, a part 76 of upper section 74 projects beyond top face 20 and is coupled with an oversized washer 78 and a cotter pin 80 for preventing removal of base member 12 from upper section 74, when base member 12 is in the support position. Stake passageways 36,46 and auger passageway 52 are only slightly oversized so that stakes 66,68 and upper section 74 of auger 70 are snugly received therein.

Although brace 18 may be connected between base member 12 and post 14 by any suitable means, base member 12 includes brace passageway 56 for receiving brace 18 therein. The lower end of brace 18 is beveled so that it lies flatly against bearing surface 58 when brace 18 is obliquely received within base member 12. Brace 18 extends upwardly toward post 14 at an acute angle relative to support face 22 and is similarly beveled at the upper end thereof for abutting post 14. A U-shaped clasp 82 wraps about post 14 and brace 18 and is clamped thereto by mechanical fasteners 84 for keeping post 14 and brace 18 interconnected.

Figure 4:
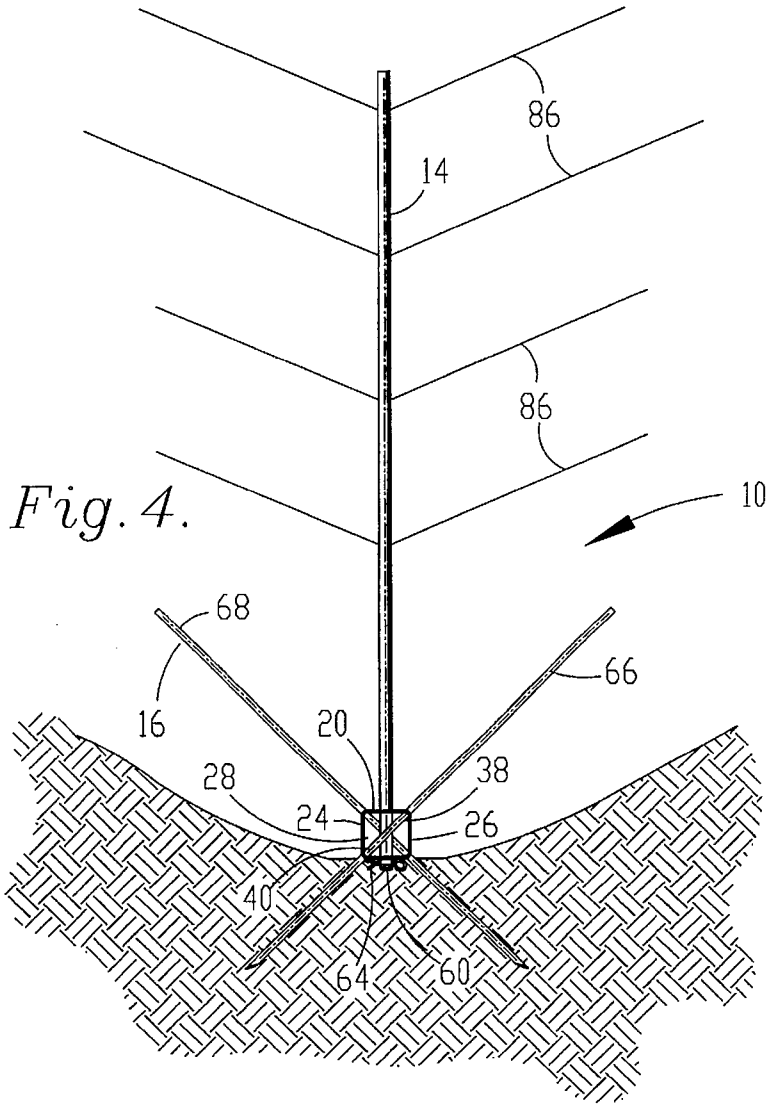
FIG. 4 is an end view of an alternative embodiment of the invention, particularly illustrating a fence post support apparatus utilizing only the stakes for anchoring the base member to the ground.

Turning to FIG. 4, an alternative embodiment of apparatus 10 is illustrated with similar components being referenced by similar numerals. The alternative embodiment does not include brace 18 nor auger 70. As will be further described hereinbelow, the alternative embodiment is particularly useful as an intermediate post along the fence run, while apparatus 10 (FIGS. 1–3) is primarily utilized as an end post at the end of the fence run.

The preferred method of installing fence post support apparatus 10 (FIGS. 1–3) includes the steps of receiving post 14 in post passageway 34 and pushing post 14 through post passageway 34 so that portion 60 projects beyond support face 22. In order to prevent removal of post 14 when base member 12 is in the support position, washer 62 is received on portion 60 and cotter pin 64 is received in the corresponding opening of post 14. Auger 70 is rotated into the ground at a desired location in the field followed by positioning base member 12 on the ground so that auger passageway 52 receives upper section 74 of auger 70, and support face 22 engages the surface of the ground and thereby supports base member 12 in the support position. The user may swing base member 12 about upper section 74 to a desired orientation. Auger 70 is rotated into the ground a sufficient depth such that part 76 projects upwardly beyond top face 20, when base member 12 is in its support position. Once properly situated, washer 78 and cotter pin 80 are coupled with part 76 in a manner similar to post 14. Alternatively, base member 12 may be anchored to the ground by stakes 66,68, which involves placing stakes 66,68 within stake passageways 36,46 and driving stakes 66,68 longitudinally into the ground by a suitable tool, such as a rubber mallet. Of course, stakes 66,68 may driven further into the ground than illustrated. If desired, both stakes 66,68 and auger 70 may be utilized to anchor base member 12 to the ground. Finally, brace 18 is connected between post 14 and base member 12 by putting brace 18 into brace passageway 58 and attaching clasp 82 about post 14 and brace 18.

The method of installation may also include the step of connecting a plurality of wires 86 to post 14 and brace 18 for support thereby. As best shown in FIG. 2, connection to post 14 or brace 18 simply involves threading wires 86 through respective openings (not shown) in post 14 and brace 19 and knotting the ends thereof. Alternatively, wires 86 may be connected to a winch 88 (FIGS. 2–3) so that the former may be tensioned. Winch 88 forms no part of the present invention, per se, and therefore it is sufficient to explain that winch 88 includes a clevis bracket 90 for connecting to brace 18, a spool 92 rotatably mounted to bracket 90 and carrying a supply of wire 86, a handle 94 for manually rotating spool 92, and a ratchet assembly (not shown) for selectively preventing rotation of spool 92. Of course, the construction of winch 88 may be varied as desired.

The sequence of steps for installing apparatus 10 may be varied as desired. Various steps may also be eliminated. As previously indicated, either stakes 66,68, auger 70, or both may be utilized to anchor base member 12 to the ground. Additionally, wires 86 are not tied to post 14 of the alternative embodiment, but are merely thread therethrough.

Removal of apparatus 10 is relatively simple. Stakes 66,68 are jarred until the surrounding soil is loosened, preferably by tapping the exposed ends of stakes 66,68 with a rubber mallet. Stakes 66,68 are pulled from the ground so that base member 12 may be lifted therefrom. Alternatively, cotter pin 80 and washer 78 are removed from part 76 of auger 70 so that base member 12 may be lifted from the ground. Auger 70 is rotated out of the ground and apparatus 10 may be relocated on the field. Wires 86 may be disconnected or remain connected to post 14 and brace 18 during relocation of apparatus 10. Although portion 60 of post 14 is illustrated below the surface of the ground, it will be appreciated that it projects only slightly into the ground and does not inhibit removal of apparatus 10.

The preferred construction, along with the corresponding procedure of installation, renders apparatus 10 sturdy and highly portable in both rocky and fine soils. With respect to apparatus 10 (FIGS. 1–3), the tension of wires 86 produce a moment (in the clockwise direction viewing FIG. 2) generally at top surface 20, which tends to urge base member 12 in a clockwise direction about post passageway 34 (viewing FIG. 2). Accordingly, the outboard end of base member 12 (left end viewing FIG. 2) is urged upwardly, while the inboard end of base member 12 (right end viewing FIG. 2) is forced downwardly into the ground. The elongated design of base member 12 has proven very effective in resisting this tendency. First, the length of base member 12 allows coupling with the various anchoring devices 16, which cooperatively prevent shifting of base member 12 along its long axis 19 and disengagement of the outboard end of support face 22 from the surface of the ground. Moreover, brace 18 bears against base member 12 and therefore does not have to be separately anchored to the ground. The inboard end of base member 12 digs into the ground as wires 86 are tensioned to further prevent rotation of apparatus 10. Finally, although post 14 is urged upwardly, washer 62 and cotter pin 64 prevent removal from base member 12.

The alternative construction has also proven very useful. As illustrated in FIG. 4, when dips in the ground are encountered, the tension of wires 86 create a generally upward force that tends to pull the apparatus out of the ground. However, the angled orientation of stakes 66,68 prevent such untoward lifting. It will be appreciated that with the alternative embodiment, brace 18 is no longer needed and base member 12 may be significantly shortened since the opposed lateral forces caused by wires 86 cancel one another. If desired, auger 70 may be used to anchor base member 12 to the ground, rather than stakes 66,68.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, rather than having a tubular configuration, base member 12 may be solid, wherein passageways 32,36,46,52 and 56 are defined by bores cut in base member 12. As desired, the components of apparatus 10 may be constructed of various materials. For example, in electrical applications, the components may be constructed of polyvinylchloride or wood; alternatively, a metal may be utilized with insulators; or apparatus 10 may be used for nonelectrical applications such as barbed wire. Finally, post 14 and stakes 66,68 may be structurally identical so that post 14 may also serve as one of the stakes, and vice versa.

The inventor hereby states his intent to rely on the Doctrine of Equivalents to determine and assess the reasonably fair scope of the present invention as pertains to any apparatus not materially departing from but outside the literal scope of the invention as set out in the following claims.

What is claimed is:

1. A fence post support apparatus comprising:

a base member presenting a support face configured for engaging the surface of the ground for supporting said base member on the ground in a support position and presenting opposed, first and second ends, said base member including support means for removably receiving a post and for supporting the post in an upright orientation when said base member is in said support position; and an anchoring device configured for insertion into the ground and having an auger flight configured for auguring into the ground and an upper section configured for extending above the surface of the ground, said base member including anchor coupling means for pivotally and slidably coupling with said upper section, said anchor coupling means being offset from said support means and positioned between said support means and said first end so that, with the post coupled with said base member in said support position, fence wire tension in the direction of said second end produces a moment urging said second end into the ground and urging said first end upwardly from the surface of the ground, said anchor coupling means including constraint means for limiting upward movement of said first end relative to said anchoring device.

2. The apparatus as set forth in claim 1, said support means including structure defining a post passageway configured for receiving the post, said post passageway extending through said base member transverse to said support face.

3. The apparatus as set forth in claim 2, further including said post; and prevention means for preventing removal of said post from said base member.

4. The apparatus as set forth in claim 3, said post passageway allowing a portion of said post to project beyond said support face when said base member is in said support position, said prevention means including a pin configured for reception through said portion and a washer configured for reception on said portion between said pin and said support face.

5. The apparatus as set forth in claim 1, said anchor coupling means including structure defining an auger passageway configured for receiving said upper section therethrough, said auger passageway extending through said base member transverse to said support face.

6. The apparatus as set forth in claim 5, said auger passageway allowing a part of said upper section to project outwardly beyond said base member when said base member is in said support position, said anchor coupling means including a pin configured for reception through said part and a washer configured for reception on said part between said pin and said base member.

7. The apparatus as set forth in claim 1, further including a brace connectable between said post and said base member.

8. The apparatus as set forth in claim 7, said base member including structure defining a brace passageway terminating at a bearing surface within said base member, said brace passageway being spaced from the post received by said base member and configured for receiving said brace therein, said brace passageway extending outwardly from said bearing surface toward said post received in said base member at an acute second angle relative to said support face.

9. The apparatus as set forth in claim 8, further including said post; and prevention means for preventing removal of said post from said base member.

10. The apparatus as set forth in claim 1, said base member being elongated and having a generally rectangular cross-section, presenting a top face generally parallel to said support face, said base member defining a long axis generally parallel to said top and support faces.

11. The apparatus as set forth in claim 10, said base member being tubular.

12. A fence post support apparatus comprising:

a post; and a base member presenting a support face configured for engaging the surface of the ground for supporting said base member on the ground in a support position, said base member including support means for removably receiving said post and for supporting the post in an upright orientation when said base member is in said support position; and an anchoring device configured for insertion into the ground, said base member including coupling means for coupling said base member with said anchoring device for preventing said support face from disengaging the surface of the ground after said device is inserted into the ground, said coupling means being spaced from said support means, said base member being elongated and presenting a long axis generally parallel to said support face, said support means including structure defining a post passageway configured for receiving the post, said post passageway extending through said base member transverse to said support face, said anchoring device including a pair of stakes, said coupling means including structure defining a pair of stake passageways, each of said stake passageways configured for receiving one of said stakes therethrough, each of said stake passageways extending through said base member at an acute first angle relative to said support face and transverse to said long axis, said stake passageways being spaced from one another and transverse relative to one another, said post passageway being positioned between said stake passageways;

prevention means for preventing removal of said post from said base member; and a brace connectable between said post and said base member, said base member including structure defining a brace passageway terminating at a bearing surface within said base member, said brace passageway being spaced from said post passageway and configured for receiving said brace therein, said brace passageway extending outwardly from said bearing surface toward said post received in said base member at an acute second angle relative to said support face.

13. The apparatus as set forth in claim 12, said first angle being about 45 degrees.

14. The apparatus as set forth in claim 12, further including a plurality of winches connectable to said post and said brace for supporting individual wires and allowing tensioning of the same.

15. A fence post support apparatus comprising:

a post; and a base member presenting a support face configured for engaging the surface of the ground for supporting said base member on the ground in a support position, said base member including support means for removably receiving said post and for supporting the post in an upright orientation when said base member is in said support position; and an anchoring device configured for insertion into the ground, said base member including coupling means for coupling said base member with said anchoring device for preventing said support face from disengaging the surface of the ground after said device is inserted into the ground, said coupling means being spaced from said support means, said base member being elongated and presenting opposed ends and a long axis generally parallel to said support face, said support means including structure defining a post passageway configured for receiving the post, said post passageway extending through said base member transverse to said support face, said anchoring device including an elongated auger presenting an upper section and having an auger flight, said coupling means including structure defining an auger passageway adjacent one of said ends of said base member configured for receiving said upper section therethrough, said auger passageway extending through said base member transverse to said support face, constraint means for preventing removal of said base member from said upper section;

prevention means for preventing removal of said post from said base member; and a brace connectable between said post and said base member, said base member including structure defining a brace passageway terminating at a bearing surface within said base member, said brace passageway being adjacent another of said ends and configured for receiving said brace therein, said brace passageway extending outwardly from said bearing surface toward said post received in said base member at an acute second angle relative to said support face.

16. The apparatus as set forth in claim 15, further including a plurality of winches connectable to said post and said brace for supporting individual wires and allowing tensioning of the same.

17. A method of installing a fence post support apparatus, comprising the steps of:

(a) positioning a base member presenting a support face on the ground so that said support face engages the surface of the ground for supporting said base member in a support position, said base member including opposed, first and second ends and support means for removably receiving a post and for supporting said post in an upright orientation when said base member is in said support position, and including anchor coupling means for coupling said base member with an anchoring device, said coupling means being spaced from said support means, step (a) including the step of receiving said post in said support means and coupling fence wire with said post under tension and extending in the direction of said second end, said anchor coupling means being offset from said support means and positioned between said support means and said first end so that said fence wire tension produces a moment urging said second end into the ground and urging said first end upwardly from the surface of the ground; and (b) coupling said anchoring device with said base member, step (b) including the step of inserting said anchoring device into the ground for preventing said support face from disengaging the surface of the ground.

18. The method as set forth in claim 17; and (c) connecting a brace between said post and said base member.

19. The method as set forth in claim 17, said base member being elongated and presenting opposed ends, said coupling means including structure defining an auger passageway adjacent one of said ends configured for receiving said upper section therethrough, said auger passageway extending through said base member transverse to said support face, step (b) further including the step of rotating said auger into the ground before step (a), and subsequently positioning said base member in said support position so that said auger passageway receives said upper section of said auger.

20. The method as set forth in claim 17, step (a) including the step of coupling prevention means with said post for preventing removal of said post from said base member.

21. The method as set forth in claim 20 further including (c) connecting a brace between said post and said base member.

22. The method as set forth in claim 17, said support means including structure defining a post passageway configured for receiving said post, said post passageway extending through said base member transverse to said support face, said receiving step including the step of pushing said post through said post passageway so that a portion of said post projects beyond said support face, and said coupling step including the steps of receiving a washer on said part, and connecting a pin to said part so that said washer is positioned between said pin and said base member.

23. The method as set forth in claim 17, (c) connecting a brace between said post and said base member.

24. The method as set forth in claim 23, said base member including structure defining a brace passageway terminating at a bearing surface within said base member, said brace passageway being spaced from said post received by said base member and configured for receiving said brace therein, said brace passageway extending outwardly from said bearing surface toward said post at an acute second angle relative to said support face, step (c) including the step of putting said brace into said brace passageway so that said brace bears against said bearing surface.

25. The method as set forth in claim 17; and (c) connecting a number of wires to said post.

26. The method as set forth in claim 17;

(c) removing said anchoring device from the ground;

(d) moving said base member to a new location; and (e) repeating steps (a) and (b).

27. A method of installing a fence post support apparatus, comprising the steps of:

(a) positioning a base member presenting a support face on the ground so that said support face engages the surface of the ground for supporting said base member in a support position, said base member including support means for removably receiving a post and for supporting said post in an upright orientation when said base member is in said support position, and including coupling means for coupling said base member with an anchoring device, said coupling means being spaced from said support means, step (a) including the step of receiving said post in said support means; and (b) coupling said anchoring device with said base member, step (b) including the step of inserting said anchoring device into the ground for preventing said support face from disengaging the surface of the ground, said base member being elongated and presenting a long axis generally parallel to said support face, said anchoring device including a stake, said coupling means including structure defining a stake passageway configured for receiving said stake therethrough, said stake passageway extending through said base member at an acute first angle relative to said support face and transverse to said long axis, step (b) including the steps of placing said stake in said stake passageway, and driving said stake longitudinally into the ground, wherein the apparatus includes two of said stakes add two of said stake passageways spaced from one another and transverse relative to one another, repeating said placing and driving steps for both of said stakes, step (a) including the step of coupling prevention means with said post for preventing removal of said post from said base member; and (c) connecting a brace between said post and said base member, said base member including structure defining a brace passageway terminating at a bearing surface within said base member, said brace passageway being spaced from said post passageway and configured for receiving said brace therein, said brace passageway extending outwardly from said bearing surface toward said post received in said base member at an acute second angle relative to said support face, step (c) including the step of putting said brace into said brace passageway so that said brace bears against said bearing surface.

28. A method of installing a fence post support apparatus, comprising the steps of:

(a) positioning a base member presenting a support face on the ground so that said support face engages the surface of the ground for supporting said base member in a support position, said base member including support means for removably receiving a post and for supporting said post in an upright orientation when said base member is in said support position, and including coupling means for coupling said base member with an anchoring device, said coupling means being spaced from said support means, step (a) including the step of receiving said post in said support means; and (b) coupling said anchoring device with said base member, step (b) including the step of inserting said anchoring device into the ground for preventing said support face from disengaging the surface of the ground, said base member being elongated and presenting opposed ends, said anchoring device including an elongated auger presenting an upper section and having an auger flight, said coupling means including structure defining an auger passageway adjacent one of said ends configured for receiving said upper section therethrough, said auger passageway extending through said base member transverse to said support face, step (b) further including the step of rotating said auger into the ground before step (a), and subsequently positioning said base member in said support position so that said auger passageway receives said upper section of said auger, step (b) including the step of attaching constraint means to said upper section for preventing removal of said base member from said upper section, a part of said upper section projecting outwardly beyond said base member when said base member is in said support position, said attaching step including the steps of receiving a washer on said part, and connecting a pin to said part so that said washer is positioned between said pin and said base member, step (a) including the step of coupling prevention means with said post for preventing removal of said post from said base member; and (c) connecting a brace between said post and said base member, said base member including structure defining a brace passageway terminating at a bearing surface within said base member, said brace passageway being adjacent another of said ends and configured for receiving said brace therein, said brace passageway extending outwardly from said bearing surface toward said post received in said base member at an acute second angle relative to said support face, step (c) including the step of putting said brace into said brace passageway so that said brace bears against said bearing surface.

29. A fence post support apparatus comprising:

a fence post;

a base member presenting a support face configured for engaging the surface of the ground for supporting said base member on the ground in a support position and presenting opposed, first and second ends, said base member including support means for removably receiving said post and for supporting said post in an upright orientation when said base member is in said support position;

an anchoring device configured for insertion into the ground and having an auger flight augured into the ground and an upper section extending above the surface of the ground, said base member including anchor coupling means pivotally coupling with said upper section; and fence wire coupled with said post under tension and extending in the direction of said second end, said anchor coupling means being offset from said support means and positioned between said support means and said first end so that said fence wire tension produces a moment urging said second end into the ground and urging said first end upwardly from the surface of the ground, said anchor coupling means including constraint means for limiting upward movement of said first end relative to said anchoring device.

* * * * *